United States Patent [19]

Geluk

[11] 4,039,815

[45] Aug. 2, 1977

[54] ELECTRO-OPTICAL CORRELATOR

[75] Inventor: Ronald Jan Geluk, Nootdorp, Netherlands

[73] Assignee: N. V. Optische Industrie "De Oude Delft", Netherlands

[21] Appl. No.: 623,946

[22] Filed: Oct. 20, 1975

[30] Foreign Application Priority Data

Oct. 28, 1974 Netherlands ..... 7414060

[51] Int. Cl.[2] ..... G06G 7/19; G06G 7/78

[52] U.S. Cl. ..... 235/181; 340/3 D; 343/100 CL

[58] Field of Search ..... 250/237, 216, 213 R, 250/213 YT; 343/100 CL; 235/181; 340/3 D

[56] References Cited

U.S. PATENT DOCUMENTS

| | | | |
|---|---|---|---|
| 3,211,898 | 10/1965 | Fomenko | 343/100 CL X |
| 3,270,315 | 8/1966 | Parks | 343/100 CL X |
| 3,526,893 | 9/1970 | Skenderoff et al. | 343/100 CL X |
| 3,816,735 | 6/1974 | Bromley | 343/100 CL X |
| 3,956,728 | 5/1976 | Wood et al. | 343/100 CL X |

*Primary Examiner*—Richard A. Farley
*Attorney, Agent, or Firm*—Marn & Jangarathis

[57] ABSTRACT

A system for electro-optically correlating two signals. A running representation of the amplitude variation of a first signal is observed through a mask representing the amplitude variation of a second signal. Means are provided for integrating the resultant light signal and for generating an electrical output signal representing the correlation function of the first and the second signal.

8 Claims, 6 Drawing Figures

ELECTRO-OPTICAL CORRELATOR

The invention relates to a system for electro-optically correlating two signals.

Such a system may be used for comparing a transmitted measuring signal to a returning echo signal by correlation. In the medical field such a procedure may find application, for example, in echography, in which ultrasonic sound pulses or wave packets are passed through a patient and the reflection caused by one or more organs of the patient is received. A similar procedure takes place in sonar systems.

Supposing that one signal, for example a transmitted signal, is $g(t)$ and the other signal, for example a received signal, is $f(t)$, the correlation function reads:

$$\gamma(\tau) = \int_{t=-\infty}^{t=\infty} f(t)\, g(t-\tau)\, dt$$

in which $\tau$ is the timing displacement between $f(t)$ and $g(t)$.

In general, the correlation function provides a signal that is defined better than signals achieved by the conventional techniques, such as envelope detection.

Hitherto, however, it has been difficult to form a correlation function as this requires both a continuous multiplication of two signals which are displaced relative to each other through all possible values of $\tau$, an an integration. These operations require complex computing arrangements and even then the computation of the correlation function takes a rather long time, so that this function is not available right away.

It is an object of the present invention to provide a system for electro-optically correlating signals which does not entail the above drawback. To achieve this object, in accordance with the invention a system of the above type is characterized by means for forming a running repesentation of the amplitude variation of one signal, by at least one masking means having a geometric configuration representing the amplitude variation of the other signal, and by means for observing the running representation through the masking means as well as for integrating the observed signal.

The invention will be described in detail hereinafter with reference to the accompanying drawings, in which.

Figure 1:
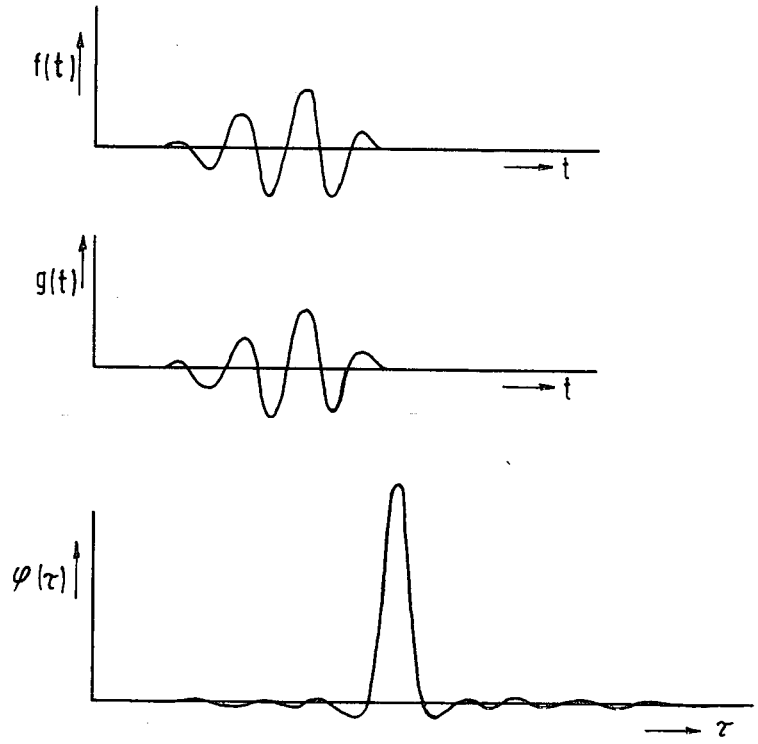
FIG. 1 shows possible signal shapes $f(t)$ and $g(t)$ and the associated correlation function.

By way of example, FIG. 1 shows the correlation function $\phi(\tau)$ of two signals $f(t)$ and $g(t)$. For example, $g(t)$ may be the electrical representation of an ultrasonic wave packet used in medical echography or in sonar, while $f(t)$ may be the received signal.

Figure 2:
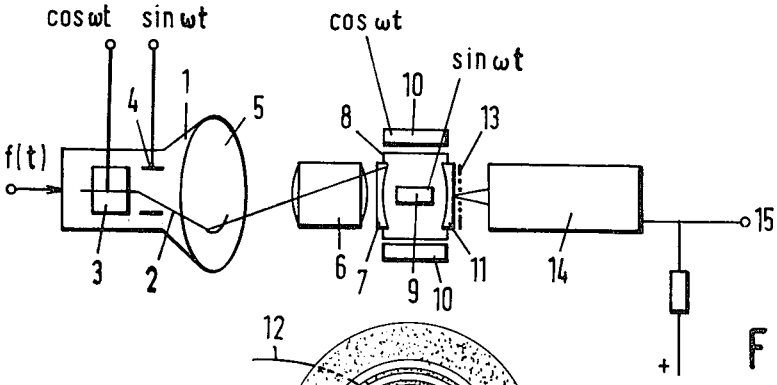
FIG. 2 shows an embodiment of a system according to the invention.

FIG. 2 shows a system according to the invention. The signal $f(t)$ is applied to a cathode ray tube 1 for modulating the intensity of an electron beam 2. The beam can be circularly deflected by means of cosinusoidal or sinusoidal voltages, indicated by coswt and sinwt, respectively, which voltages are applied to horizontal and vertical plates 3 and 4, respectively, Thus a ciruclar light track is formed on the screen 5, which track retains the intensity distribution of the signal $f(t)$ for a short while due to the phosphorescence of the screen. In order to reproduce also the negativeportions of $f(t)$ on the screen 5, a DC component may be added to $f(t)$. Preferably, the persistence has a value so that the wave packet $f(t)$ or a relevant portion thereof is stored temporarily.

The screen 5 of the cathode ray tube may be reproduced through an objective 6 on the photocathode 7 of an image intensifier tube 8. The tube 8 comprises vertical deflection coils 9 and horizontal deflection coils 10, to which sinusoidal and cosinusoidal currents are applied, respectively, which currents correspond to the voltages applied to the vertical and horizontal deflection plates of the cathode ray tube 1, respectively. In this manner it is realized that the dot travelling on the screen 5 of the cathode ray tube 1 is reproduced on the anode 11 of the image intensifier tube 8 as a stationary dot located in the center of this anode, the phosphorescing track of varying intensity being reproduced on the screen 5 as an arcuate light track 12 originating from the central dot and rotating about this dot at an angular frequency $\omega$.

Figure 3:
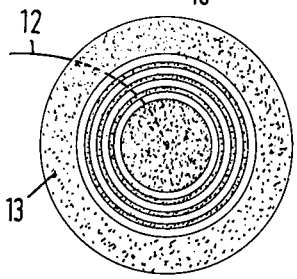
FIG. 3 shows a correlation mask for use in the system shown in FIG. 2.

FIG. 3 shows a rotation-symmetric correlation mask 13 mounted on the outside of the anode 11, the light transmission of the mask in radial direction corresponding with $g(t)$. As $g(t)$ can have positive and negative values and negative light transmission is impossible, the mast 13 must have a mean transmission greater than zero. The correlation mask may be manufactured by known photographic techniques, starting from the shape of the transmitted wave packet.

The light track 12, which is a representation of $f(t)$, is transmitted in this manner in accordance with a representation of $g(t)$. The transmitted light signal, if necessary after deletion of a DC component, will be porportional to $f(t-\tau).g(t)$, which, as known from the theory of the correlation function, provides the same result as the multiplication $f(t).g(t-\tau)$.

FIG. 2 further shows a photomultiplier tube 14 mounted behind the correlation mask 13, which tube performs the integration over the area contributing to the correlation function. Instead of a photomultiplier tube a different light detector may be used. At the output 15 of the photomultiplier tube 14 a signal is produced in this manner which consists of the correlation function $\phi(\tau)$ and a DC voltage component, the latter being of no further interest.

In the arrangement described above the mask 13 corresponds to the transmitted signal $g(t)$. However, it is also possible to use a mask including a function differing from the transmitted signal so as to be able to detect certain characteristic reflections. It is known from the art of medical echography that the different tissues have characteristic reflections, which implies that also tissue deviations have characteristic reflections. When a plurality of correlation masks is available which each correspond to a characteristic reflection, it is possible to detect known deviations, for example by successively placing the correlation masks behind the image intensifier. The amplitudes of the resultant correlation functions provide an indication of the deviation present.

Figure 4:
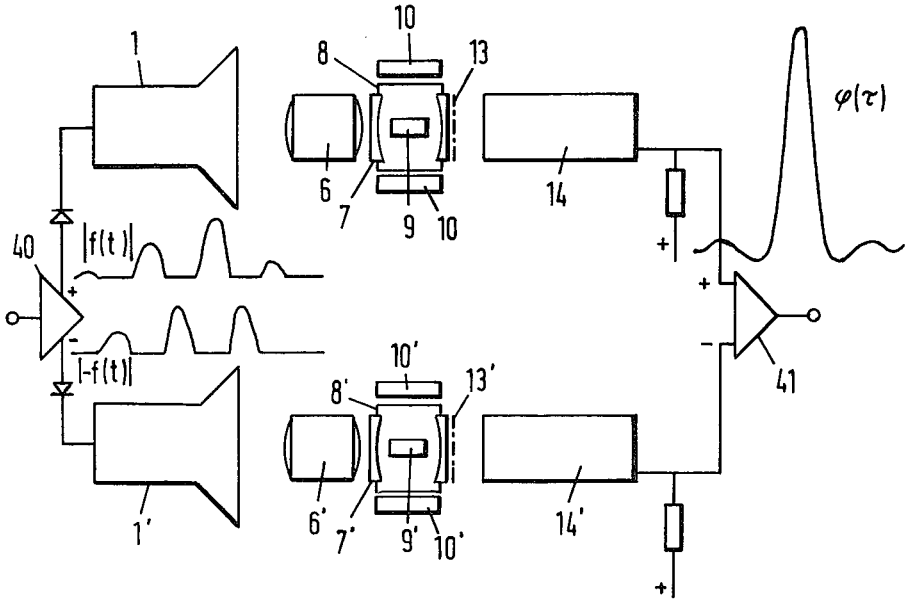
FIG. 4 shows a variant of the embodiment shown in FIG. 2.

FIG. 4 shows a further embodiment of the system shown in FIG. 2. In this embodiment the input signal is divided by means of an amplifier 40 into a positive and an inverted, negative portion, so that no DC voltage component need be added so as to be able to reproduce also the negative portion of the signal as a variation in the light intensity. The correlation is performed in a push-pull correlation system with appropriate correlation masks. The push-pull correlation system comprises two systems according to FIG. 2 as well as an additional input amplifier 40 and a recombination amplifier 41 at the output. The result is a correlation function $\phi(\tau)$ without added DC component. This has the advantage of optimally low photon noise.

Figure 5:
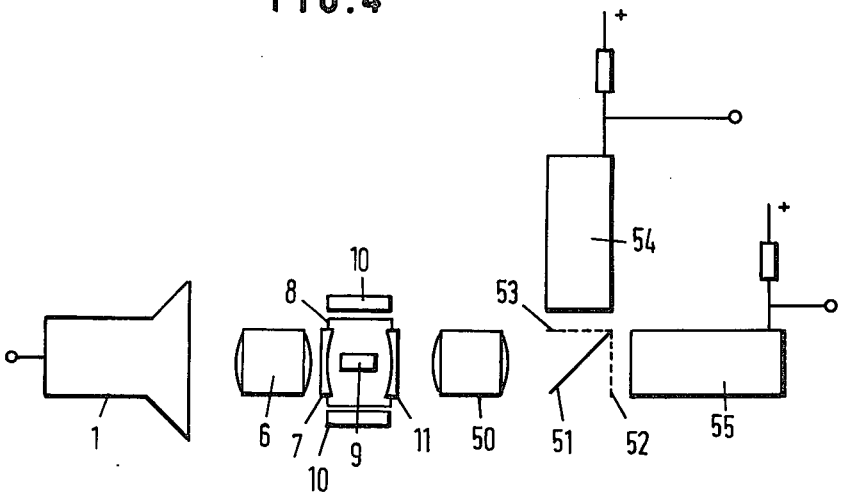
FIG. 5 shows another variant of the embodiment shown in FIG. 2.

FIG. 5 shows a correlation system suited for Doppler detection. Its operation is as follows: due to reflections of the ultrasonic wave packet to organs or objects with a velocity component in the direction of the sound wave, the received wave packet is slightly lengthened or shortened in time. When the received signal is applied to the input, the Doppler displacement can be determined by means of two correlation masks 52, 53 included in the system, one mask producing a slight magnification and the other mask producing a slight reduction relative to the mask associated with the transmitted signal. To this end, a second objective 50 is mounted behind the image intensifier tube 8, which objective 50 is followed by a beam splitter 51. Correlation masks 52, 53 of the type described above are mounted on either side of the beam splitter, each mask followed by a photomultiplier tube 54, 55, respectively. In this manner two output signals are produced whose ratio is indicative of the Doppler displacement and whose sum represents the intensity of the signal received.

It is observed that in actual practice the above systems may include a radially extending grey filter to compensate for the decreasing intensity of the light track on the anode screen of the image intensifier. This filter may be mounted between the image intensifier and the correlation mask.

The rotation frequency $\omega$ is a compromise determined by the persistence of the screen of the cathode ray tube and the track length to be used for each wave packet as, if after one rotation the phosphor of the cathode ray tube is not yet fully extinguished, a residual signal is formed which has an undesirable effect on the correlation function.

It is further observed that in the system described the input signal is reproduced on the screen of the cathode ray tube along a circular track. However, a different shape of the track, for example a straight line, is also feasible. In the event of a linear track the correlation mask should be adapted accordingly.

Figure 6:
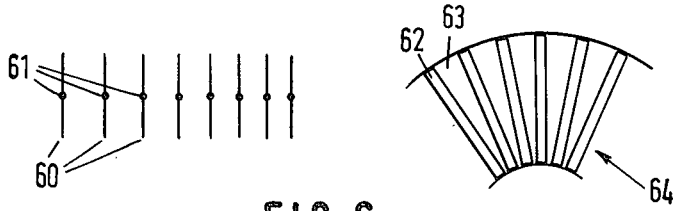
FIG. 6 shows an embodiment of a masking means suited for a specific purpose.

Finally, FIG. 6 shows the manner in which Doppler displacements can be detected by means of only one masking means. In this embodiment, the running representation of one signal consists of a succession of parallel lines 60 each formed by extending points (61) on a linear running representation having, for example, a light intensity exceeding a given value. The masking means 64 includes radially extending regions 62, 63 having different light transmission factors.

I claim:

1. A system for electro-optically correlating two signals, characterized by: means for forming a running representation of the amplitude variation of one of said signals, and comprised of a cathode ray tube having a phosphorescent screen, said cathode ray tube including deflection plates controlled to produce a light track on said phosphorescent screen, each point of said track having a brightness corresponding to the instantaneous amplitude of said one of said signals; at least one masking means having a geometric configuration representing the amplitude variation of the other of said signals; an image intensifier tube, said image intensifier tube having deflection coils energized so that a dot travelling on said phosphorescent screen of said cathode ray tube is reproduced as a stationary dot on an anode of said image intensifier tube; and means for observing the running representation through said masking means and for integrating the observed signal.

2. The system according to claim 1, and further including an objective mounted between said phosphorescent screen and said image intensifier tube.

3. The system according to claim 1 characterized in that said masking means includes areas arranged so that the light transmission, along a line each time corresponding to said running representation of said one of said signals on said anode, represents the amplitude variation of said other signal.

4. The system according to claim 1 characterized in that said means for observing and integrating said observed signal is a light detector.

5. The system according to claim 1 characterized by light distributing means each followed by a masking means, each masking means representing a different amplitude variation, the running representation of said one of said signals being concurrently observable and integrable through each masking means by a light detector.

6. The system according to claim 5 characterized in that at least one of said masking means represents a compressed representation of a signal and at least one further masking means represents an expanded representation of said signal so as to determine Doppler displacements.

7. The system according to claim 1 wherein said masking means has a spatially varying light transmission factor.

8. The system according to claim 6, characterized by said masking means being provided with a spatially varying light transmission factor so that said masking means represents both a compressed and an expanded representation of a signal.

* * * * *

UNITED STATES PATENT OFFICE

CERTIFICATE OF CORRECTION

Patent No. 4,039,815 Dated 8/2/77

Inventor(s) Ronald Jan Geluk

It is certified that error appears in the above-identified patent and that said Letters Patent are hereby corrected as shown below:

Col. 1, line 19, delete "γ" and insert --Y--. (Y=wye)
line 30, delete "an" (first occurence) and insert --and--;
line 61, delete "ϕ" and insert --Y--.
Col. 2, line 3, delete "respectively," and insert --respectively.--;
line 7, delete "negativeportions" and insert --negative portions--;
line 53, delete "ϕ" and insert --Y--.
Col. 3, line 12, delete "ϕ" and insert --Y--.

Signed and Sealed this

Twenty-eighth Day of March 1978

[SEAL]

Attest:

RUTH C. MASON
Attesting Officer

LUTRELLE F. PARKER
Acting Commissioner of Patents and Trademarks